United States Patent [19]

Lotto et al.

[11] 4,017,932

[45] Apr. 19, 1977

[54] TEMPORARY, MODULAR, SELF-ERECTING BRIDGE

[76] Inventors: Sergio Lotto; Francesco Saggin, both of via Andrea Memmo, 11, Padua, Italy

[22] Filed: Dec. 13, 1974

[21] Appl. No.: 532,604

[30] Foreign Application Priority Data

Dec. 20, 1973 Italy ..... 41684

[52] U.S. Cl. ..... 14/2.4; 52/646; 182/152; 14/5

[51] Int. Cl.[2] ..... E01D 15/12

[58] Field of Search ..... 14/1, 3, 14, 5, 13, 14/2.4; 52/646, 645, 648, 655, 641, 640, 109, 143, 693, 633; 182/152

[56] References Cited

UNITED STATES PATENTS

| | | | |
|---|---|---|---|
| 414,843 | 11/1889 | Olsen | 14/5 |
| 509,781 | 11/1893 | Weiss | 14/3 |
| 919,100 | 4/1909 | Wedmore | 52/646 |
| 1,141,385 | 6/1915 | Ellinger | 52/646 |
| 1,176,994 | 3/1916 | Spelling | 14/3 |
| 1,376,990 | 5/1921 | Zabriskie | 52/693 |
| 2,365,175 | 12/1944 | Crawford | 52/693 X |
| 2,459,800 | 1/1949 | Esgate | 52/646 X |
| 3,315,421 | 4/1967 | Roy | 52/143 X |
| 3,354,596 | 11/1967 | Schafer | 182/152 X |
| 3,394,419 | 7/1968 | Sedlacek | 14/13 |
| 3,729,877 | 5/1973 | Hall | 52/109 |
| 3,782,674 | 1/1974 | Smith | 14/5 X |
| 3,783,573 | 1/1974 | Vaughan | 182/152 X |

*Primary Examiner*—Nile C. Byers
*Attorney, Agent, or Firm*—Bacon & Thomas

[57] ABSTRACT

A temporary, modular, self-erecting bridge which can be transported from place-to-place by collapsing the side, top and bottom elements about pivot points to achieve a narrow and shorter unit. Hydraulic jacks or other fluid actuated mechanisms are used to expand and contract the elements.

23 Claims, 21 Drawing Figures

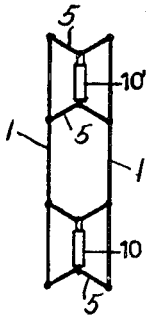
FIG.5
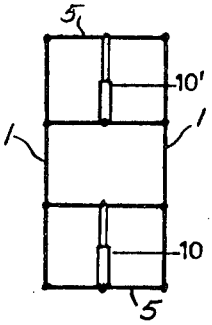
FIG.6
FIG.7
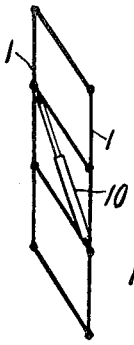
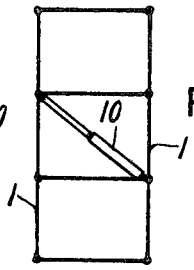
FIG.8
FIG.9
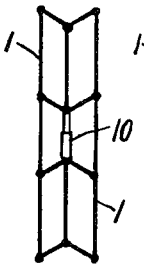
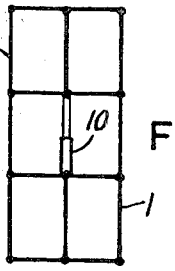
FIG.10
FIG.11
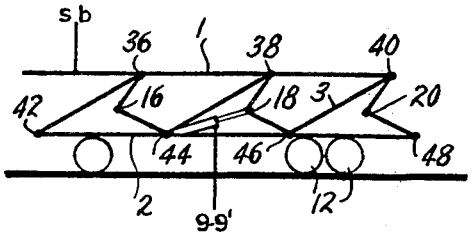
FIG.12
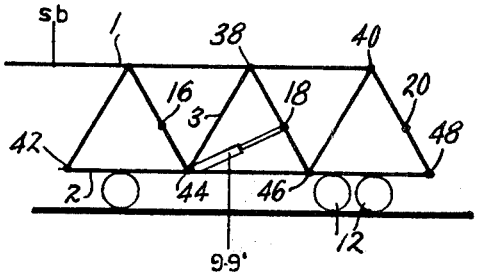
FIG.13
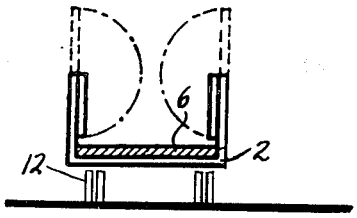
FIG.14
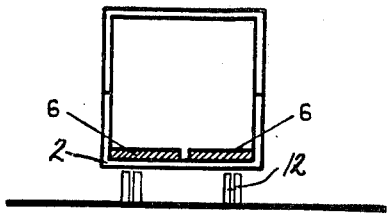

TEMPORARY, MODULAR, SELF-ERECTING BRIDGE

BACKGROUND OF THE INVENTION

The invention relates to a temporary, modular, self-erecting bridge which is collapsable and transportable from location to location.

During major maintenance and construction of roads, bridges, and the like, it is necessary to either totally or partially break up the road surface. During such major construction and maintenance projects it is normally necessary to close the affected road or bridge. Thus, it is necessary to either reroute or construct temporary structures. The building of temporary bridges and the like results in a temporary interruption of traffic during the phases of erection and dismantling of the bridges.

SUMMARY AND OBJECTS OF THE INVENTION

It is an object of the present invention to provide a rapid, easy and economical solution to the problem by the construction of transportable temporary bridges. As will be seen below, it is possible to construct such bridges in one, two or more selferecting sections, connected one to the other, thus providing a bridge the span of which is a multiple of the modular base elements.

In the present invention each modular base element is mounted on a series of one, two or more rubber or other wheel bases. This permits practical and easy transportation of the modular base element by road or rail. The unit can be towed by a suitable tractor trailer or transported by appropriately designed railway cars.

Each modular element is provided with a series of double-action hydraulic jack means positioned near two extremities for the purpose of raising a base element or a plurality of base elements simultaneously to a preselected height.

The side load-bearing girders must be positioned three or four meters from each other during use in order to permit vehicles to travel thereover. However, this distance is normally too wide for transportation along existing highways. Therefore, a purpose of the present invention is to provide collapsable elements which can be collapsed and opened by means of hydraulic or other mechanical devices.

The height of load-bearing side girders of the base element normally cannot exceed four meters in certain localities during transportation, but must have a greater height while in service. Thus, the invention provides a means for collapsing the height of the load-bearing side girders during transportation and erecting same to their proper height during use.

Another object of the invention is to provide means for connecting the upper bridles of the load-bearing girders together in such a way as to achieve a closed upper section of the bridge during service.

Another object is to provide the base element of the bridge with access ramps to incorporate it with the existing road way.

Another object is to provide the bridge with adequate fixed and sliding supports suitable both as to load bearing capacity and range which is necessary during use.

A further object is to provide the extremities of the modular base element with self-centering and self-aligning devices, particularly useful for the purpose of facilitating the connection of two or more modular elements together.

BRIEF DESCRIPTION OF THE DRAWINGS

The above and other objects of the invention will be seen from the following description and accompanying drawings, wherein:

FIG. A is a perspective view of the unit fully constructed, certain elements being in schematic form;

Figure 1:
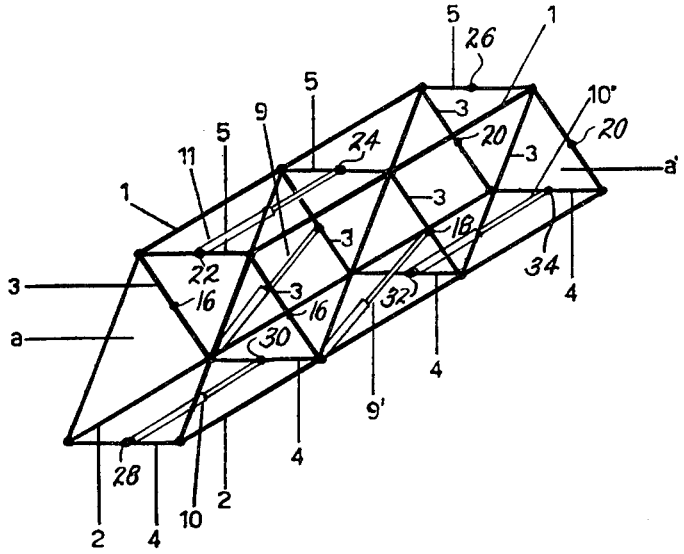
Figure 2:
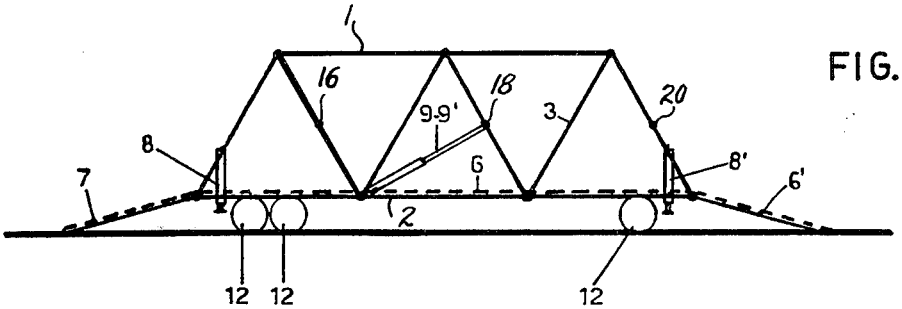
Figure 3:
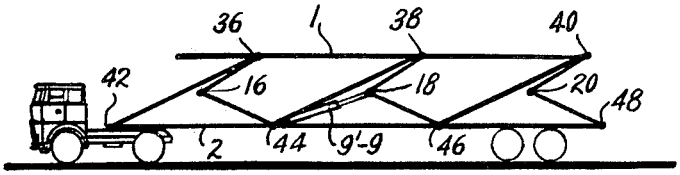
Figure 4:
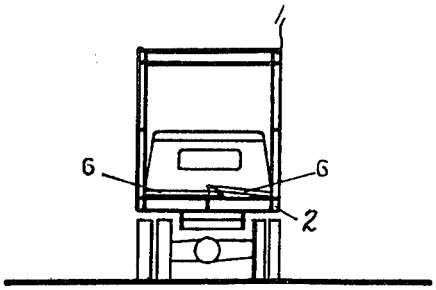
Figure 15:
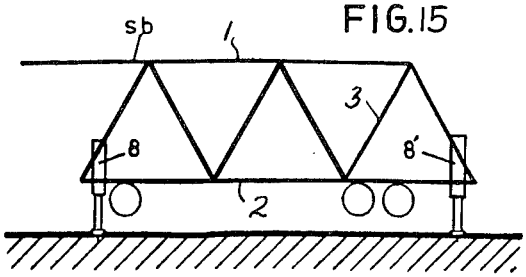
Figure 16:
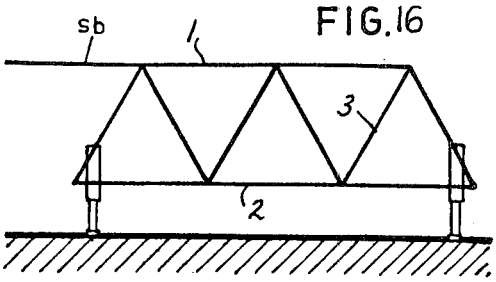
Figure 17:
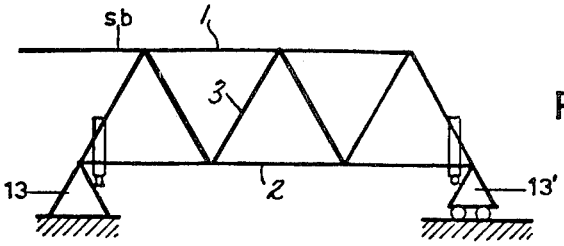
Figure 18:
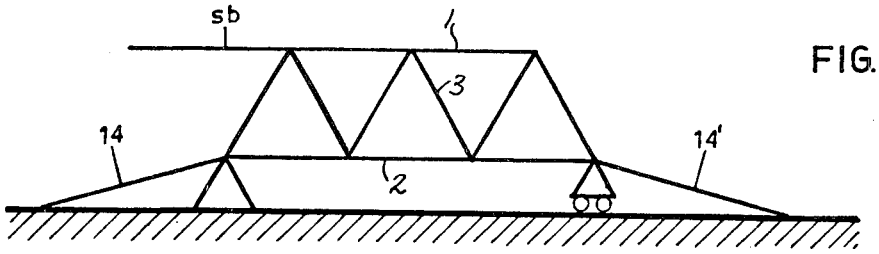
Figure 19:
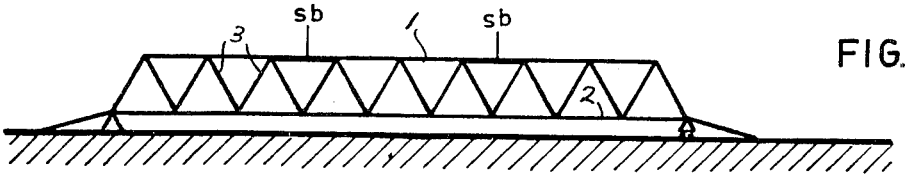
Figure 20:
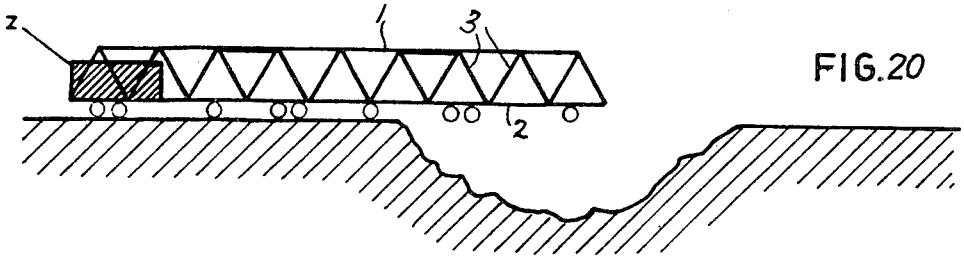
Figure 21:
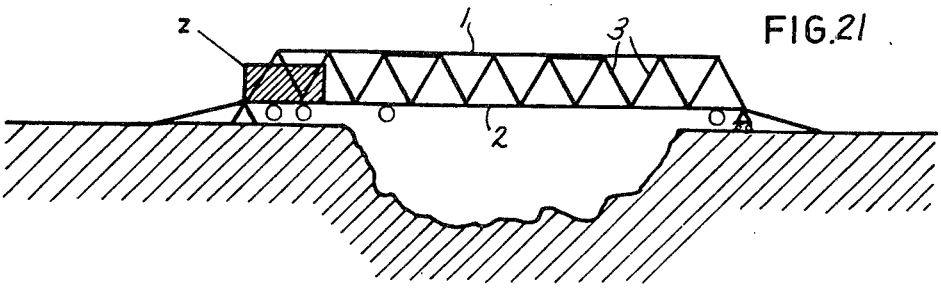

FIG. B is a side elevation of the bridge of FIG. A when it is in place;

FIG. C is a side elevation view of the bridge module being transported;

FIG. D is an end view of the unit of FIG. C;

FIG. E is a top plan view of the base element in a semicollapsed position;

FIG. F is a top plan view similar to FIG. E with the base element completely expanded in its open position;

FIG. E', F', E'' and F'' are modifications of FIGS. E and F;

FIG. G illustrates a side view of the bridge element in its transporting position;

FIG. G'' illustrates an end view of the unit being transported with the body portion in the folded position;

FIG. H illustrates the side portion of FIG. G in its erected position upon arriving at the site;

FIG. I is an end view of the unit of FIG. D;

FIG. L, M and N are side views of the unit as it is being put in place;

FIG. O is a side view of the unit of FIG. N with access ramps in place;

FIG. P is a view of several modules connected together;

FIGS. Q and S illustrate the use of the invention including a plurality of modules being positioned as a bridge over a river, ravine or the like.

DETAILED DESCRIPTION OF THE INVENTION

Referring now to FIG. A which illustrates a modular unit of the instant invention with various elements in schematic, it will be noted that a pair of side bodies *a* and *a'* have an upper bridle 1 and a lower bridle 2. The bridles are connected by a plurality of diagonals 3, a plurality of lower cross members 4 and upper cross members 5. A roadway 6 seen in FIG. B is positioned on the element, and if necessary a pair of access ramps 6' and 7 can be added with the roadway thereon.

A pair of hydraulic jacks 8 and 8' are positioned at the extremities of the module for a purpose to be discussed below. Each side girder is provided with a hydraulic jack element 9 or 9'. The lower base element includes hydraulic jacks 10 and 10' while the upper element includes a hydraulic jack 11 between a pair of upper cross members 5.

At the modular base element is fixed on one, two or more common or solid rubber wheeled trains or boggies 12 for transportation from place to place. When in place, as seen in FIGS. N and O, supports 13 and 13' can be used, as can access ramps 14 and 14'.

For transportation from one place to another the side body elements *a* and *a'* are provided with pivots at points 16, 18 and 20. The upper elements are provided with pivots at 22, 24 and 26 while the lower base element is provided with pivots at 28, 30, 32 and 34. The diagonals 3 which are not pivoted in the middle may be removable.

During transportation by road, the modular element will appear in side view as seen in FIG. C wherein hydraulic elements 9 and 9' are contracted, and the elements 3 will pivot at points 16, 18 and 20, as well as points 36, 38, 40, 42, 44, 46 and 48. While pivots points have not been shown in all instances, it will be appreciated that these pivots are necessary for the unit to operate.

In FIG. D an end view of the unit being transported in FIG. C is shown. It will be appreciated that as hydraulic elements 10 and 10' operate, the roadway 6 will pivot and overlap as seen in the end view in FIG. D.

Once the unit has arrived at the site where the unit is to be utilized, the following operation will be carried out: The unit will first be detached from the trailer. The two side body portions will be spread apart by actuation of elements 10, 10' and 11 which, acting on the lower and upper cross members respectively, gradually align the members to a maximum width. FIGS. E and F show a bottom element being separated; whereas, FIGS. E', F' and E'' and F'' show alternative embodiments.

The opening of the bottom section is followed by opening of the side sections as seen in FIGS. G and H wherein hydraulic jacks 9 and 9' cause the upper bridles to rise from a collapsed position to an open position seen in FIGS G and H respectively. Also, as seen in FIG. G'' it is possible to fold the body sides inwardly from the dotted position to the solid position. All elements are appropriately locked after expansion by mechanical or hydraulic means.

With the two body sides spread apart, it is possible to obtain alignment of the two roadways which are seen in overlapping position in FIG. D to that shown in FIG. I. Alternatively, the roadways could be pivoted from a vertical position to the position seen in FIG. I. In the opening operation, jacks 8 and 8' are brought into operation as seen in FIG. L. These hydraulic jacks raise the wheels from the ground so as to permit detachment of the wheels or mobile mechanism from the unit as seen in FIG. M. This maneuver is then followed by the positioning of supports 13 and 13' at the ends of the modular base element as seen in FIG. N. The jacks are then retracted and access ramps 14 and 14' are positioned as seen in FIG. O.

When a bridge is composed of several modular elements, the various operations discussed above are analogous. However, one must add the appropriate linking elements such as a projecting extension sb as seen in the various figures. Element sb is used to contact a plurality of modules together as seen in FIG. P.

The temporary bridge can be used in a variety of situations. It can be used over existing roadways which are having major maintenance thereon as for example in FIG. P or it can be used to increase the number of existing bridges or be a substitution for bridges which may have been washed out or otherwise made impassable. As seen in FIG. Q and S the bridge module can be extended across a river or ravine by using a suitable counter weight *z*.

While one embodiment of the invention has been described, it will be understood that it is capable of many further modifications and this application is intended to cover any variations, uses or adaptations of the invention following in general, the principles of the invention and including such departures from the present disclosure as come within knowledge or customary practice in the art to which the invention pertains, and as may be applied to the essential features hereinbefore set forth and fall within the scope of the invention or the limits of the appended claims.

We claim:

1. A temporary, modular self-erecting bridge comprising:

a. At least one module for spanning a distance, said module being mobile for movement from place to place, b. said module comprising a pair of load-bearing side elements, a base element and a top element, c. a number of mechanical means for opening said module by changing the height and width of said module, d. said side elements comprising a number of diagonal elements including a number of elements pivotable about a point between their ends and responsive to said mechanical opening means, wherein e. the number of pivotable elements is greater than the number of mechanical means, whereby said bridge is transportable as a single structure having smaller physical dimension in its collapsed, transported state than in an open, erected state, and whereby a small number of mechanical means are used to erect a module comprising a substantially larger number of pivotable elements.

2. A bridge as defined in claim 1 including wheels on said module.

3. A bridge as defined in claim 1 wherein said side elements include an upper bridle and a lower bridle, said diagonal elements being pivoted at their ends to said upper and lower bridles.

4. A bridge as defined in claim 3 wherein alternating diagonal elements are also pivotable between the ends thereof.

5. A bridge as defined in claim 4 wherein the diagonal elements which are not pivotable between their ends are removable.

6. A bridge as defined in claim 1 wherein said side elements include diagonal elements pivotable between their ends whereby the upper portion of said sides can be folded 180° into the lower portion thereof.

7. A bridge as defined in claim 3 including means for causing said diagonal elements to pivot from a collapsed position to a raised position.

8. A bridge as defined in claim 7 wherein said causing means are fluid operated telescoping elements.

9. A bridge as defined in claim 1 including jacks for raising and lowering said modular element relative to the ground.

10. A bridge as defined in claim 1 including extension means for joining a plurality of modules together.

11. A bridge as defined in claim 1 wherein said module includes a pair of substantially planar roadway members which are movable from an overlapping position during transporting movement to a substantially co-planar position during use.

12. A bridge as defined in claim 1 including an access ramp at at least one end of said module.

13. A bridge as defined in claim 3 wherein said base element includes a plurality of pivotable cross members connected to said lower bridles, a fluid actuated element to cause said side elements to be moved closer together by pivoting said cross members.

14. A bridge as defined in claim 13 wherein said cross members are pivotable at their ends.

15. A bridge as defined in claim 14 wherein said cross members are also pivotable between their ends.

16. A bridge as defined in claim 1 wherein said top element includes a plurality of pivotable top cross members, and fluid actuated means for causing said top cross members to pivot.

17. A bridge as defined in claim 1 wherein said mechanical means comprise hydraulic expansion and contraction means.

18. A bridge as defined in claim 17 wherein said hydraulic expansion and contraction means cause said pivotable elements to pivot from a collapsed position to an expanded position.

19. A bridge as defined in claim 18 wherein said expanded position of said pivotable elements comprises a raised position thereof for changing said height of said module.

20. A bridge as defined in claim 19 further comprising pivoted elements included in said top and base elements of said module and mechanical means for pivoting said pivoted elements thereby changing said width of said module.

21. A self-erecting transportable module for spanning a distance and permitting vehicular traffic to travel thereover comprising:

a two load-bearing side elements, a base element and a top element, b said side elements comprising a plurality of pivoted diagonal members, alternating diagonal members being pivotable at a point between the ends thereof, c each side element having mechanical means operatively connected to one of said alternating diagonal members for causing said element to expand, thereby causing others of said alternating diagonal elements to expand, thereby causing said side element to change its height, d said base and top elements comprising members pivotable at a point between the ends thereof, e mechanical means in said top and base elements for causing said pivotable elements to expand, thereby causing said top and base elements to change their widths, f upper and lower bridles in said side element, and g extension means for joining said module to another such module when said module's span is shorter than said distance.

22. A module as defined in claim 21 wherein said mechanical means comprise fluid actuated telescoping elements.

23. A bridge for vehicular traffic comprising at least one module as defined in claim 21.

* * * * *